US007276853B2

(12) United States Patent
Van Der Pol et al.

(10) Patent No.: US 7,276,853 B2
(45) Date of Patent: Oct. 2, 2007

(54) LOW-PRESSURE MERCURY VAPOR DISCHARGE LAMP

(75) Inventors: Adrianus Johannes Hendricus Petrus Van Der Pol, Roosendaal (NL); Leonie Maria Geerdinck, Eindhoven (NL); Engelbertus Cornelius Petrus Maria Vossen, Eindhoven (NL); Ingrid Jozef Maria Snijkers-Hendrickx, Eindhoven (NL); Roland Blasig, Aachen (DE); Simon Krijnen, Eindhoven (NL); Ronald Arjan Van Den Brakel, Roosendaal (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 300 days.

(21) Appl. No.: 10/510,296

(22) PCT Filed: Apr. 9, 2003

(86) PCT No.: PCT/IB03/01433

§ 371 (c)(1),
(2), (4) Date: Oct. 6, 2004

(87) PCT Pub. No.: WO03/085695

PCT Pub. Date: Oct. 16, 2003

(65) Prior Publication Data

US 2005/0194905 A1 Sep. 8, 2005

(30) Foreign Application Priority Data

Apr. 11, 2002 (EP) ..... 02076442

(51) Int. Cl.
*H01J 17/16* (2006.01)

(52) U.S. Cl. ..... 313/635; 313/573; 313/493

(58) Field of Classification Search ..... 313/567, 313/636, 634, 238, 239, 352, 492, 493, 609, 313/613, 616
See application file for complete search history.

(56) References Cited

U.S. PATENT DOCUMENTS

| | | | |
|---|---|---|---|
| 2,419,902 | A | 4/1947 | Mager |
| 2,671,184 | A | 3/1954 | Kenty |
| 2,714,681 | A | 8/1955 | Keiffer et al |
| 2,915,664 | A | 12/1959 | Lemmers |
| 2,916,645 | A | 12/1959 | Salo et al |
| 2,965,789 | A | 12/1960 | Lemmers |
| 2,973,447 | A | 2/1961 | Aicher et al |

(Continued)

FOREIGN PATENT DOCUMENTS

| | | |
|---|---|---|
| GB | 667070 | 2/1952 |

(Continued)

*Primary Examiner*—Joseph Williams

(57) ABSTRACT

Low-pressure mercury vapor discharge lamp has an at least partly substantially cylindrical discharge vessel (10) with a length Ldv and with an internal diameter Din. The discharge vessel (10) encloses, in a gastight manner, a discharge space (13) provided with a inert gas mixture and with mercury. The discharge vessel (10) comprises discharge means (electrodes 20*a;* 20*b*) for maintaining a discharge in the discharge space (13). According to the invention, the ratio of the weight of mercury mHg in the discharge vessel (10) to the product of the internal diameterDin and the length of the discharge vessel Ldv is given by the relation: wherein C (0.01 (g/mm2. Preferably, 0.0005 (C(0.005(g/mm2. Preferably, the discharge vessel (10) contains less than 0.1 mg mercury. The discharge lamp according to the invention operates under unsaturated mercury conditions.

20 Claims, 7 Drawing Sheets

U.S. PATENT DOCUMENTS

| | | | | |
|---|---|---|---|---|
| 3,013,169 | A | 12/1961 | Bitter et al | |
| 3,526,804 | A | 9/1970 | Chalmers et al | |
| 4,374,340 | A * | 2/1983 | Bouwknegt et al. | 313/608 |
| 6,362,570 | B1 | 3/2002 | Chandler | |

FOREIGN PATENT DOCUMENTS

| | | |
|---|---|---|
| GB | 857711 | 1/1961 |
| WO | 20199637907 | 4/1996 |
| WO | WO 200139244 | 5/2001 |
| WO | WO 200167486 | 9/2001 |
| WO | WO 200171770 | 9/2001 |

* cited by examiner

LOW-PRESSURE MERCURY VAPOR DISCHARGE LAMP

The invention relates to a low-pressure mercury vapor discharge lamp comprising an at least partly substantially cylindrical discharge vessel with a length $L_{dv}$ and with an internal diameter $D_{in}$.

the discharge vessel enclosing, in a gastight manner, a discharge space provided with a mixture of inert gases and with mercury, the discharge vessel comprising discharge means for maintaining a discharge in the discharge space.

The invention also relates to a compact fluorescent lamp.

In mercury vapor discharge lamps, mercury constitutes the primary component for the (efficient) generation of ultraviolet (UV) light. A luminescent layer comprising a luminescent material (for example, a fluorescent powder) may be present on an inner wail of the discharge vessel to convert UV to other wavelengths, for example, to UV-B and UV-A for tanning purposes (sun panel lamps) or to visible radiation for general illumination purposes. Such discharge lamps are therefore also referred to as fluorescent lamps. Alternatively, the ultraviolet light generated may be used for germicidal purposes (UV-C). The discharge vessels of low-pressure mercury vapor discharge lamps are usually circular and comprise both elongate and compact embodiments. Generally, the tubular discharge vessel of a compact fluorescent lamp comprises a collection of comparatively short straight parts having a comparatively small diameter, which straight parts are connected together by means of bridge parts or via bent parts. Compact fluorescent lamps are usually provided with an (integrated) lamp cap. Normally, the means for maintaining a discharge in the discharge space are electrodes arranged in the discharge space. In an alternative embodiment the low-pressure mercury vapor discharge lamp comprises a so-called electrodeless low-pressure mercury vapor discharge lamp.

In the description and claims of the current invention, the designation "nominal operation" is used to refer to operating conditions where the mercury vapor pressure is such that the radiation output of the lamp is at least 80% of that when the light output is a maximum, i.e. under operating conditions where the mercury vapor pressure is an optimum. In addition, in the description and claims, the "initial radiation output" is defined as the radiation output of the discharge lamp 1 second after switching-on of the discharge lamp, and the "run-up time" is defined as the time needed by the discharge lamp to reach a radiation output of 80% of that during optimum operation.

Low-pressure mercury vapor discharge lamps are known comprising an amalgam. Such discharge lamps have a comparatively low mercury vapor pressure at room temperature. As a result, amalgam-containing discharge lamps have the disadvantage that the initial radiation output is also comparatively low when a customary power supply is used to operate said lamp. In addition, the run-up time is comparatively long because the mercury vapor pressure increases only slowly after switching on the lamp.

Apart from amalgam-containing discharge lamps, low-pressure mercury vapor discharge lamps are known which comprise both a (main) amalgam and a so-called auxiliary amalgam. If the auxiliary amalgam comprises sufficient mercury, then the lamp has a comparatively short run-up time. Immediately after the lamp has been switched on, i.e. during preheating of the electrodes, the auxiliary amalgam is heated by the electrode so that it comparatively rapidly dispenses a substantial proportion of the mercury that it contains. In this respect, it is desirable that, prior to being switched on, the lamp has been idle for a sufficiently long time to allow the auxiliary amalgam to take up sufficient mercury. If the lamp has been idle for a comparatively short period of time, the reduction of the run-up time is only small. In addition, in that case the initial radiation output is (even) lower than that of a lamp comprising only a main amalgam, which can be attributed to the fact that a comparatively low mercury vapor pressure is adjusted in the discharge space by the auxiliary amalgam. An additional problem encountered with comparatively long lamps is that it takes comparatively much time for the mercury liberated by the auxiliary amalgam to spread throughout the discharge vessel, so that after switching-on of such lamps, they demonstrate a comparatively bright zone near the auxiliary amalgam and a comparatively dark zone at a greater distance from the auxiliary amalgam, which zones disappear after a few minutes.

In addition, low-pressure mercury vapor discharge lamps are known which are not provided with an amalgam and contain only free mercury. These lamps, also referred to as mercury discharge lamps, have the advantage that the mercury vapor pressure at room temperature and hence the initial radiation output are comparatively high as compared with amalgam-containing discharge lamps and as compared to discharge lamps comprising a (main) amalgam and an auxiliary amalgam. In addition, the run-up time is comparatively short. After having been switched on, comparatively long lamps of this type also exhibit a substantially constant brightness over substantially the whole length, which may be attributed to the fact that the vapor pressure (at room temperature) is sufficiently high at the time of switching-on of these lamps.

A comparatively large amount of mercury is necessary for the low-pressure mercury vapor discharge lamps known in the art in order to realize a sufficiently long lifetime. A drawback of the known discharge lamps is that they form a burden on the environment. This is in particular the case if the discharge lamps are injudiciously processed after the end of the lifetime.

It is an object of the invention to eliminate the above disadvantage wholly or partly. In particular, it is an object of the invention to provide a low-pressure mercury vapor discharge lamp for which the burden on the environment is reduced. According to a first measure of the invention, a low-pressure mercury vapor discharge lamp of the kind mentioned in the opening paragraph is for this purpose characterized in that the ratio of the weight of mercury $m_{Hg}$ in the discharge vessel to the product of the internal diameter $D_{in}$ and the length of the discharge vessel $L_{dv}$ is given by the relation:

$$\frac{m_{Hg}}{D_{in} \times L_{dv}} = C,$$

wherein $C \leqq 0.01\ \mu g/mm^2$.

A discharge vessel of a low-pressure mercury vapor discharge lamp according the first measure of the invention, having a ratio of the weight (expressed in μg) of mercury and the product of the internal diameter (expressed in mm) and the length (expressed in mm) of the discharge vessel which is below $0.01\ \mu g/mm^2$, contains a comparatively low amount of mercury. The mercury content is considerably lower than what is normally provided in known low-pressure mercury vapor discharge lamps. Given the range of the constant $C \leqq 0.01\ \mu g/mm^2$, the low-pressure mercury vapor discharge lamp according to the first measure of the invention operates for certain ambient temperatures as a so-called "unsaturated" mercury vapor discharge lamp.

The above given relation shows that the amount of mercury in the discharge lamp is proportional to the product of the internal diameter $D_{in}$ and the length of the discharge vessel $L_{dv}$. Roughly speaking, the amount of mercury in the discharge lamp is proportional to the size of the internal surface of the discharge vessel. Experiments have shown that the formula can at least be applied to low-pressure mercury vapor discharge lamps with a diameter of the discharge vessel in a range from approximately 3.2 mm (⅛ inch) to approximately 38 mm (1⅜ inch) and for (corresponding) lengths in a range from approximately 10 mm (⅓ foot) to approximately $27 \cdot 10^2$ mm (9 feet) of the discharge vessels.

In the description and claims of the current invention, the designations "unsaturated" or "unsaturated mercury conditions" are used to refer to a low-pressure mercury vapor discharge lamp in which the amount of mercury dosed into the discharge vessel (during manufacture) of the low-pressure mercury vapor discharge lamp is equal to or lower than the amount of mercury needed for a saturated mercury vapor pressure at nominal operation of the discharge lamp.

Operating a mercury vapor discharge lamp under unsaturated mercury conditions has a number of advantages. Generally speaking, the performance of unsaturated mercury discharge lamps (light output, efficacy, power consumption, etc.) is independent of the ambient temperature as long as the mercury pressure is unsaturated. This results in a constant light output which is independent on the burning position of the discharge lamp (base up versus base down, horizontally versus vertically). In practice, a higher light output of the unsaturated mercury vapor discharge lamp is obtained in the application. Unsaturated lamps combine a higher light output with an improved efficacy in applications at elevated temperatures with a minimum mercury content. This results in ease of installation and in freedom of design for lighting and luminaire designers. An unsaturated mercury discharge lamp gives a comparatively high system efficacy in combination with a comparatively low Hg content. In addition, unsaturated lamps have an improved lumen maintenance. Since the trends towards further miniaturization and towards more light output from one luminaire will continue the forthcoming years, it may be anticipated that problems with temperature in applications will occur more frequently in the future. With an unsaturated mercury vapor discharge lamp these problems are largely reduced. Unsaturated lamps combine a minimum mercury content with an improved lumen per Watt luminous efficacy performance at elevated temperatures.

When the performance of unsaturated lamps is compared with that of so-called cold-spot or so-called amalgam low-pressure mercury vapor discharge lamps, the following advantages can be mentioned. In a "cold-spot" mercury discharge lamp, the mercury pressure is controlled by a so-called cold-spot temperature somewhere in the discharge vessel. In an amalgam mercury discharge lamp, the mercury pressure is controlled by means of an amalgam; in a number of such amalgam discharge lamps an auxiliary amalgam is additionally employed. The initial radiation output and the run-up time and ignition voltage of an unsaturated mercury discharge lamp are comparable to those of cold-spot lamps. Other properties such as size (no cold-spot area necessary in an unsaturated discharge lamp; e.g. by introducing long stems), life time, color temperature, color rendering index, and reliability are at the same level as in known mercury discharge lamps. The lumen maintenance of unsaturated lamps is expected to be better than that of the known compact fluorescent lamps (CFL) and fluorescent discharge lamps (TL). With unsaturated lamps miniaturization can be driven to its limits because thermal problems are minimized. This can result in a reduction of the total cost of ownership for new installation unsaturated mercury discharge lamps.

The first measure according to the invention enables the manufacture of long-life low-pressure mercury vapor discharge lamps which operate under conditions of unsaturated mercury content. Such unsaturated mercury discharge lamps have the advantage that the burden on the environment is reduced.

Preferably, the constant C is in a range of $0.0005 \leqq C \leqq 0.005$ μg/mm$^2$. In this regime of C the upper limit of the mercury content in the discharge lamp is further reduced. In this preferred embodiment of the invention, the low-pressure mercury vapor discharge lamp according to the invention operates as an unsaturated mercury vapor discharge lamp.

Instead of expressing the mercury content in the discharge vessel in terms of the amount of mercury present in the discharge vessel, the mercury content can also be expressed as the mercury pressure in the discharge vessel of the low-pressure mercury vapor discharge lamp. According to a second measure of the invention, a low-pressure mercury vapor discharge lamp of the kind mentioned in the opening paragraph is for this purpose characterized in that the product of the mercury pressure $p_{Hg}$ and the internal diameter $D_{in}$ of the discharge vessel is in a range of $0.13 \leqq p_{Hg} \times D_{in} \leqq 8$ Pa.cm.

A discharge vessel of a low-pressure mercury vapor discharge lamp according to the second measure of the invention, in which the product of the mercury pressure (expressed in Pa) and the internal diameter (expressed in mm) of the discharge vessel lies in said range, contains a comparatively small amount of mercury. The mercury content is considerably smaller than what is normally provided in known low-pressure mercury vapor discharge lamps. The low-pressure mercury vapor discharge lamp according to the second measure of the invention operates as a so-called "unsaturated" mercury vapor discharge lamp.

Preferably, the product of the mercury pressure $p_{Hg}$ and the internal diameter $D_{in}$ of the discharge vessel is in a range of $0.13 \leqq p_{Hg} \times D_{in} \leqq 4$ Pa.cm. In this preferred regime of $p_{Hg} \times D_{in}$ the mercury content in the discharge lamp is further reduced. In this preferred embodiment of the invention, the low-pressure mercury vapor discharge lamp according to the invention operates as an unsaturated mercury vapor discharge lamp.

A preferred embodiment of the low-pressure mercury vapor discharge lamp according to the invention is characterized in that the discharge vessel contains less than approximately 0.1 mg mercury. There is a tendency in governmental regulations to prescribe a maximum amount of mercury present in a low-pressure mercury vapor discharge lamp that, if the discharge lamp comprises less than said prescribed amount, allows the user to dispose of the lamp without environmental restrictions. If a mercury discharge lamp contains less than 0.2 mg of mercury such requirements are largely fulfilled. Preferably, the discharge vessel contains less than or approximately 0.05 mg mercury ($C \approx 0.0013$).

It is not an easy task to operate a low-pressure mercury vapor discharge lamp under unsaturated mercury conditions according to the first and/or second measure of the invention while simultaneously realizing a comparatively long life of the discharge lamp. It is known that measures are taken in low-pressure mercury vapor discharge lamps to reduce the amount of mercury that is no longer able to contribute to the reactive atmosphere in the discharge space in the discharge vessel during lamp life. Mercury is lost, due to the interaction of mercury and materials present in the lamp (such as glass, coatings, electrodes), and parts of the inner wall of the discharge vessel are blackened. Wall blackening does not only give rise to a lower light output but also gives the lamp an unaesthetic appearance, particularly because the blackening occurs irregularly, for example in the form of dark stains or dots.

A preferred embodiment of the low-pressure mercury vapor discharge lamp according to the invention is characterized in that the discharge means comprises electrodes arranged in the discharge space, in that an electrode shield at least substantially surrounds at least one of the electrodes, and in that the electrode shield is made from a ceramic material or from stainless steel.

Electrodes in low-pressure mercury vapor discharge lamps comprise a so-called emitter material having a low so-called work function for supplying electrons to the discharge (cathode function) and receiving electrons from the discharge (anode function). Known materials having a low work function are, for example, barium (Ba), strontium (Sr), and calcium (Ca). It has been observed that material (barium and strontium) of the electrode(s) is subject to volatilization during operation of low-pressure mercury vapor discharge lamps. It has been found that, in general, the emitter material is deposited on the inner surface of the discharge vessel. It has further been found that the above-mentioned Ba (and Sr), when deposited elsewhere in the discharge vessel, no longer participates in the light-generating process. The deposited (emitter) material further forms mercury-containing amalgams on the inner surface, as a result of which the quantity of mercury available for the discharge operation gradually decreases, which may adversely affect lamp life. In order to compensate for such a loss of mercury, the provision of an electrode shield, which surrounds the electrode(s) and is made from a ceramic material, reduces the chemical reactions of materials in the electrode shield with the mercury present in the discharge vessel which lead to the formation of amalgams (Hg—Ba, Hg—Sr). In addition, the use of an electrically insulating material precludes the development of short-circuits in the electrode wires and/or across a number of turns of the electrode(s).

The electrode shield itself should not appreciably absorb mercury. To achieve this, the material of the electrode shield comprises at least an oxide of at least one element of the series formed by magnesium, aluminum, titanium, zirconium, yttrium, and the rare earths. Preferably, the electrode shield is made from a ceramic material which comprises aluminum oxide. Particularly suitable electrode shields are manufactured from so-called densely sintered $Al_2O_3$, also referred to as PCA. An additional advantage of the use of aluminum oxide is that an electrode shield made of such a material is resistant to comparatively high temperatures (>250° C.). At such comparatively high temperatures, there is an increased risk that the (mechanical) strength of the electrode shield decreases, thus adversely affecting the shape of the electrode shield. (Emitter) material originating from the electrode(s) and deposited on an electrode shield of aluminum oxide which is at a much higher temperature cannot or can hardly react with the mercury present in the discharge as result of said high temperature, so that the formation of mercury-containing amalgams is at least substantially precluded. In this manner, the use of an electrode shield in accordance with the invention serves a dual purpose. On the one hand, it is effectively precluded that the material originating from the electrode(s) is deposited on the inner surface of the discharge lamp, and, on the other hand, it is precluded that (emitter) material deposited on the electrode shield forms amalgams with the mercury present in the discharge lamp. Preferably, in operation, the temperature of the electrode shield exceeds 250° C. An advantage of such a comparatively high temperature is that, in particular, in the initial stage, the electrode shield becomes hotter than in the known lamp, as a result of which any mercury bound to the electrode shield is released more rapidly and more readily. In an alternative embodiment, the electrode shield is made from stainless steel. An electrode shield made of stainless steel is dimensionally stable, corrosion-resistant, and exhibits a comparatively low heat emissivity at comparatively high temperatures (above 400° C.).

An alternative embodiment of the discharge lamp in accordance with the invention comprises the so-called electrodeless discharge lamps, in which the means for maintaining an electric discharge are situated outside a discharge space surrounded by the discharge vessel. Generally said means are formed by a coil provided with a winding of an electrical conductor, with a high-frequency voltage, for example having a frequency of approximately 3 MHz, being supplied to said coil in operation. In general, said coil surrounds a core of a soft-magnetic material.

An alternative, preferred embodiment of the low-pressure mercury vapor discharge lamp according to the invention is characterized in that the product of the pressure of an inert gas mixture $p_{igm}$ and the internal diameter $D_{in}$ of the discharge vessel is in a range of $p_{igm} \times D_{in} > 5.2$ Pa.m.

This embodiment of the invention is based on the recognition that a higher filling pressure of the rare gas mixture leads to a reduced mercury depletion in the lamp. The filling pressure of the rare gas mixture in the conventional low-pressure mercury discharge lamp is usually made to depend on the lamp diameter, for which it is true that the greater the diameter of the lamp, the lower the filling pressure which is chosen. A rule of thumb usually applied is that the product of the pressure of the rare gas mixture and the diameter of the discharge vessel must not be greater than a certain constant, for example 5.0 mPa. This leads to a maximum filling pressure of the rare gas mixture of 500 Pa for a discharge lamp having a diameter of 10 mm, to a maximum filling pressure of the rare gas mixture of 310 Pa for a discharge lamp with a diameter of 15.8 mm (⅝ inch), and to a maximum filling pressure of the rare gas mixture of 200 Pa for a diameter of 25.4 mm (⅝ inch). It is normally assumed that a higher filling pressure of the rare gas mixture has a significant negative effect on the luminous efficacy of the lamp. However, a higher filling pressure of the rare gas mixture has a positive influence on the mercury consumption of the discharge lamp, and thus on lamp life.

Not wishing to be held to any particular theory, it is believed that an explanation for the lower mercury consumption of the lamp at a higher filling pressure may be that the mercury ions, which move with high velocity through the discharge vessel, are decelerated by the additional rare gas atoms, so that said ions collide with the discharge vessel wall at a lower velocity and are less readily absorbed therein. As a result, there will be less wall blackening of the discharge lamp, and less mercury need be introduced into the lamp during manufacture for maintaining an unsaturated mercury vapor pressure throughout lamp life.

Preferably, $p_{igm} \times D_{in} > 8$ Pa.m, more preferably at least 12.0 Pa.m. It was found in experiments that the mercury consumption becomes lower in proportion as the filling pressure becomes higher. There is indeed a maximum filling pressure for which, when it is exceeded, the mercury consumption does not decrease substantially any more, while also the adverse effects on the luminous efficacy start to become noticeable. This maximum, however, seems to be dependent on the current through the lamp. The advantages of a higher filling pressure of the rare gas mixture manifest themselves especially in lamps of somewhat greater diameter, which had very low filling pressures of the rare gas mixture until now, such as a lamp having a diameter $D_{in}$ of 15.9 mm (⅝ inch), or the widely used 25.4 mm (⅝ inch). Preferably, the filling pressure of the rare gas mixture $P_{igm}$ of such a lamp is at least 200 Pa, more preferably at least 520 Pa, even more preferably at least 800 Pa.

An alternative, preferred embodiment of the low-pressure mercury vapor discharge lamp according to the invention is characterized in that at least a portion of an inner wall of the discharge vessel is provided with a protective layer, and in that the protective layer comprises a material selected from the group formed by oxides of scandium, yttrium, and a further rare-earth metal, and/or a material selected from the group formed by borates of an alkaline-earth metal, scandium, yttrium, and a further rare-earth metal, and/or a material selected from the group formed by phosphates of an alkaline-earth metal, scandium, yttrium, and a further rare-earth metal.

Protective layers comprising the oxides, borates, and/or phosphates according to this embodiment of the invention appear to be very well resistant to the effect of the mercury plus rare gas atmosphere which, in operation, prevails in the discharge vessel of a low-pressure mercury vapor discharge lamp. It has been found that the mercury consumption of low-pressure mercury vapor discharge lamps provided with a protective layer comprising said oxides, borates, and/or phosphates is considerably lower than in protective layers of the known low-pressure mercury vapor discharge lamp. The effect occurs both in straight parts and in bent parts of (tubular) discharge vessels of low-pressure mercury vapor discharge lamps. Bent lamp parts are used, for example, in hook-shaped low-pressure mercury vapor discharge lamps.

The protective layer in the low-pressure mercury vapor discharge lamp according to this embodiment of the invention further, satisfies the requirements of light and radiation transmissivity. The protective layer may be easily provided as comparatively thin, closed and homogeneous layer on the inner wall of a discharge vessel of a low-pressure mercury vapor discharge lamp. Said protective layer may be manufactured, for example, by flushing the discharge vessel with a solution of a mixture of suitable metal-organic compounds (for example, acetonates or acetates, for example, scandium acetate, yttrium acetate, lanthanum acetate, or gadolinium acetate mixed with calcium acetate, strontium acetate, or barium acetate) and boric acid or phosphoric acid diluted in water, whereupon the desired layer is obtained after drying and sintering.

Preferably, the alkaline-earth metal is calcium, strontium; and/or barium. A protective layer with said alkaline-earth metals exhibits a comparatively high coefficient of transmission for visible light. Moreover, low-pressure mercury vapor discharge lamps with protective layers comprising calcium borate or phosphate, strontium borate or phosphate, or barium borate or phosphate have a good lumen maintenance. Preferably, the further rare-earth metal is lanthanum, cerium, and/or gadolinium. Protective layers with said rare-earth metals have a comparatively high coefficient of transmission for ultraviolet radiation and visible light. Moreover, the layer can be provided in a comparatively simple manner (for example with lanthanum acetate, cerium acetate, or gadolinium acetate mixed with boric acid or diluted phosphoric acid), which has a cost-saving effect, notably in a mass manufacturing process for low-pressure mercury vapor discharge lamps. Preferably, the protective layer comprises an oxide of yttrium and/or gadolinium. Such a protective layer has a comparatively high coefficient of transmission for ultraviolet radiation and visible light. Moreover, the layers can be provided in a comparatively easy manner (for example, with yttrium acetate or gadolinium acetate), which has an additional cost-saving effect. Preferably, the protective layer has a thickness of approximately 5 nm to approximately 200 nm. At a layer thickness of more than 200 nm, there is a too strong absorption of the radiation generated in the discharge space. At a layer thickness of less than 5 nm, there is interaction between the discharge and the wall of the discharge vessel. Layer thicknesses of at least substantially 90 nm are particularly suitable. At such layer thicknesses, the protective layer has a comparatively high reflectivity in the wavelength range around 254 nm.

An alternative, preferred embodiment of the low-pressure mercury vapor discharge lamp according to the invention is characterized in that the discharge vessel is made from a glass comprising silicon dioxide and sodium oxide, with a glass composition comprising the following essential constituents, given in percentages by weight (wt. %): 60–80 wt. % $Sio_2$, and 10–20 wt. % $Na_2O$. A discharge vessel of a low-pressure mercury vapor discharge lamp having the above glass composition and comprising a protective layer appears to be very well resistant to the action of the mercury rare gas atmosphere. In addition, the glass is comparatively inexpensive. In known discharge lamps use is made of a so-called mixed alkali glass having a comparatively low $SiO_2$ content. The cost price of said glass is comparatively high. A comparison between the composition of the known glass and the glass in accordance with the invention shows that the alkali content is different. The glass in accordance with the invention is a so-called sodium-rich glass with a comparatively low potassium content, whereas the known glass is a so-called mixed alkali glass having an approximately equal molar ratio of $Na_2O$ and $K_2O$. An advantage is that the mobility of the alkali ions in the sodium-rich glass is comparatively high compared with the mobility in the mixed alkali glass. In addition, melting of sodium-rich glass is comparatively easier than melting mixed alkali glass.

Preferably, the glass composition comprises the following constituents: 70–75 wt. % $SiO_2$, 15–18 wt. % $Na_2O$, and 0.25–2 wt. % $K_2O$. The composition of such a sodium-rich glass is similar to that of ordinary window glass and it is comparatively cheap with respect to the glass used in the known discharge lamp. In addition, the conductance of said sodium-rich glass is comparatively low; at 250° C. the conductance is approximately log $\rho$=6.3, while the corresponding value of the mixed alkali glass is approximately log $\rho$=8.9.

The above sodium-rich glass is suitably employed in combination with the protective layer as described. In an alternative embodiment to be described hereinafter, a type of glass is used which exhibits a very low mercury consumption in the absence of a protective layer. To this end, an alternative preferred embodiment of the low-pressure mercury vapor discharge lamp according to the invention is characterized in that the discharge vessel is made from a glass which is substantially free of PbO and which comprises, expressed as a percentage by weight (denoted by wt. %), the following constituents: 55–70 wt. % $SiO_2$, less than 0.1 wt. % $Al_2O_3$, 0.5–4 wt. % $Li_2O$, 0.5–3 wt. % $Na_2O$, 10–15 wt. % $K_2O$, 0–3 wt. % MgO, 0–4 wt. % CaO, 0.5–5 wt. % SrO, 7–10 wt. % BaO. This glass has a liquidus temperature ($T_{liq}$) which is at least 100° C. lower than that of the glasses which are usually employed. Such a glass has favorable fusion and processing properties. The glass composition is very suitable for drawing glass tubing and for use as a lamp envelope in a fluorescent lamp, in particular a tubular lamp envelope for a compact fluorescent lamp (CFL), in which the wall load is higher than in a "TL" lamp (normal straight tubular fluorescent lamp) owing to the smaller diameter of the lamp envelope. The glass can also suitably be used to manufacture bulb-shaped lamp envelopes for fluorescent lamps, such as the so-called electrodeless or "QL" mercury vapor discharge lamps. The glass can also suitably be used to manufacture other parts of the lamp envelope, such as stems.

This glass composition does not comprise the detrimental components PbO, F, $As_2O_3$, and $Sb_2O_3$. The $SiO_2$ content of the glass in accordance with the invention is limited to 55–70 wt. %. In combination with the other constituents, said $SiO_2$ content leads to a readily fusible glass. As is known in the art, $SiO_2$ serves as a cross-linking agent. If the $SiO_2$ content is below 55 wt. %, the cohesion of the glass and the chemical resistance are reduced. An $SiO_2$ content above 70 wt. % hampers the vitrification process, causes the viscosity to become too high, and increases the risk of surface crystallization. The absence of $Al_2O_3$ has the following advantages. The liquidus temperature ($T_{liq}$) is reduced by avoiding the forming of feldspar-like crystals, for example microcline or orthoclase ($K_2O.Al_2O_3.6SiO_2$). The absence of $Al_2O_3$ in the glass composition, as compared to that of the glass compositions known in the art, does not have a detrimental influence on the chemical resistance nor on the resistance against weathering of the glass. In addition, the glass without $Al_2O_3$ exhibits a low crystallization tendency as well as a viscosity and softening temperature ($T_{soft}$) enabling a good processing of the glass.

The alkali metal oxides $Li_2O$, $Na_2O$, and $K_2O$ are used as a melting agent and lead to a reduction of the tile viscosity of the glass. If the alkali metal oxides are used in the above composition, the so-called mixed-alkali effect will cause the electrical resistance to be increased and $T_{liq}$ to be reduced. In addition, it is predominantly the alkali metal oxides that determine the thermal expansion coefficient $\alpha$ of the glass. This is important because it must be possible to seal the glass to the stem glass and/or the current supply conductors, for example, of copper-plated iron/nickel wire in such a way that the glass is free from stress. If the alkali-metal-oxide content is below the indicated limits, the glass will have a too low $\alpha$-value (coefficient of thermal expansion), and $T_{soft}$ (softening point) will be too high. Above the indicated limits, the $\alpha$-value will be too high. $Li_2O$ causes a greater reduction of $T_{soft}$ than $K_2O$, which is desirable to obtain a wide so-called "Working Range" ($=T_{work}-T_{soft}$). Too high an $Li_2O$ content leads to an excessive increase of $T_{liq}$. In addition, $Li_2O$ is an expensive component, so that, also from an economical point of view, the $Li_2O$ content is limited.

BaO has the favorable property that it causes the electrical resistance of the glass to increase and $T_{soft}$ to decrease. Below 7 wt. %, the melting temperature ($T_{melt}$), $T_{soft}$, and the working temperature ($T_{work}$) increase too much. Above 10 wt. %, the liquidus temperature ($T_{liq}$) and hence the crystallization tendency increase too much. The alkaline earth metal oxides SrO, MgO, and CaO have the favorable property that they lead to a reduction of $T_{melt}$.

Preferably, the composition of the glass comprises: 65–70 wt. % $SiO_2$, 1.4–2.2 wt. % $Li_2O$, 1.5–2.5 wt. % $Na_2O$, 11–12.3 wt. % $K_2O$, 1.8–2.6 wt. % MgO, 2.5–5 wt. % CaO, 2–3.5 wt. % SrO, 8–9.5 wt. % BaO. The glass according to this preferred embodiment of the invention has a favorable $T_{liq} \leqq 800°$ C. and hence hardly tends towards crystallization during the manufacture of the glass and during the drawing of glass tubing from said glass. By virtue of a wide Working Range of at least 310° C. and a low $T_{soft}$ (700° C.), the glass can be shaped into a tube without any problems by means of, for example, the Danner or the Vello process, known in the art. Said glass has favorable fusion and processing properties. The thermal expansion coefficient can be tuned to match the glass with other glasses. The glass composition according to the preferred embodiment of the invention is very suitable for drawing glass tubing and for use as a lamp envelope or stem in a fluorescent lamp.

Preferably, the sum of the concentrations of $Li_2O$, $Na_2O$, and $K_2O$ is in a range from 14 to 16 wt. %. Preferably, the sum of the concentrations of SrO and BaO is in the range from 10 to 12.5 wt. %. Keeping the concentrations in the preferred ranges reduces the cost price of the glass. The glass composition in accordance with the invention can be refined by means of $Na_2SO_4$, so that the glass may contain up to 0.2 wt. % $SO_3$. The glass may additionally contain an impurity in the form of, maximally, 0.2 wt. % $Fe_2O_3$, which originates from the raw materials used. If necessary, up to 0.2 wt. % $CeO_2$ is added to the glass to absorb undesirable UV radiation.

In order to attain a satisfactory lumen maintenance of the lamp and a suppressed mercury consumption, it is known in the art to provide the inner surface of the lamp envelope with a protective coating, for example of $Y_2O_3$. In the case of a glass composition according to the preferred embodiment of the low-pressure mercury vapor discharge lamp according to the invention described above, a protective coating and hence an additional process step are no longer necessary, leading to a cost reduction in lamp manufacture.

These and other aspects of the invention are apparent from and will be elucidated with reference to the embodiments described hereinafter.

In the drawings.

The Figs. are purely diagrammatic and not drawn to scale. Notably, some dimensions are shown in a strongly exaggerated form for the sake of clarity. Similar components in the Figs. are denoted as much as possible by the same reference numerals.

Figure 1A:
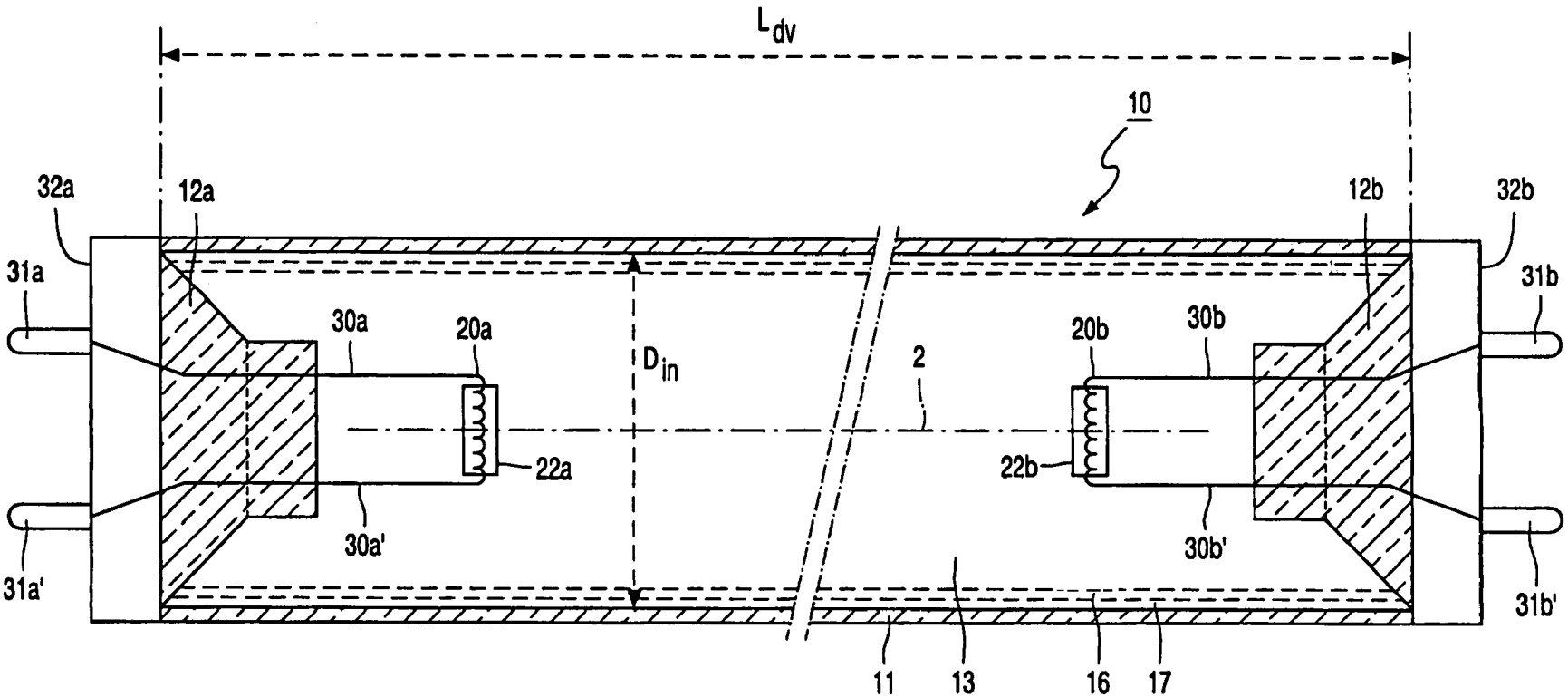
FIG. 1A is a longitudinal sectional view of an embodiment of the low-pressure mercury apor discharge lamp in accordance with the invention.

FIG. 1 shows a low-pressure mercury vapor discharge lamp comprising a glass discharge vessel having a tubular portion 11 about a longitudinal axis 2, which discharge vessel transmits radiation generated in the discharge vessel 10 and is provided with a first and a second end portion 12*a*; 12*b*, respectively. In this example, the tubular portion 11 has a length $L_{dv}$ of 120 cm and an inside diameter $D_{in}$ of 24 mm. The discharge vessel 10 encloses, in a gastight manner, a discharge space 13 containing a filling of mercury and an inert gas mixture comprising, for example, argon. The side of the tubular portion 11 facing the discharge space 13 is provided with a protective layer 17 according to an embodiment of the invention. In an alternative embodiment, the first and second end portions 12*a*; 12*b* are also coated with a protective layer. In fluorescent discharge lamps, the side of the tubular portion 11 facing the discharge space 13 is in addition coated with a luminescent layer 16 which comprises a luminescent material (for example a fluorescent powder) which converts the ultraviolet (UV) light generated by fallback of the excited mercury into (generally) visible light. In an alternative embodiment, the luminescent layer 16 is in addition provided with a further protective layer (not shown in FIG. 1A). In the example of FIG. 1A, means for maintaining a discharge in the discharge space 13 are electrodes 20*a*; 20*b* arranged in the discharge space 13, said electrodes 20*a*; 20*b* being supported by the end portions 12*a*; 12*b*. Each electrode 20*a*; 20*b* is a winding of tungsten covered with an electron-emitting substance, in this case a mixture of barium oxide, calcium oxide, and strontium oxide. Current-supply conductors 30*a*, 30*a*'; 30*b*, 30*b*' of the electrodes 20*a*; 20*b*, respectively, pass through the end portions 12*a*; 12*b* and issue from the discharge vessel 10 to the exterior. The current-supply conductors 30*a*, 30*a*'; 30*b*, 30*b*' are connected to contact pins 31*a*, 31*a*'; 31*b*, 31*b*' which are secured to a lamp cap 32*a*, 32*b*. In general, an electrode ring (not shown in FIG. 1A) is arranged around each electrode 20*a*; 20*b*, on which ring a glass capsule for dispensing mercury is clamped.

In the example shown in FIG. 1A, the electrode 20*a*; 20*b* is surrounded by an electrode shield 22*a*; 22*b* which, in accordance with an embodiment of the invention, is made from a ceramic material. Preferably, the electrode shield is made from a ceramic material comprising aluminum oxide. Particularly suitable electrode shields are manufactured from so-called densely sintered $Al_2O_3$, also referred to as PCA. Preferably, the temperature of the electrode shield 22*a*; 22*b* is 450° C. during nominal operation. At said temperature, dissociation causes mercury bonded to BaO or SrO on the electrode shield 22*a*; 22*b* to be released again, so that it is available for the discharge in the discharge space. In an alternative embodiment, the electrode shield 22*a*; 22*b* is made from stainless steel. At said high temperature, such an electrode shield is dimensionally stable, corrosion-resistant, and exhibits a comparatively low heat emissivity. A material which can suitably be used to manufacture the electrode shield is chromium-nickel-steel (AlSi 316) having the following composition (in % by weight): at most 0.08% C, at most 2% Mn, at most 0.0045% P, at most 0.030% S, at most 1% Si, 16–18% Cr, 10–14% Ni, 2–3% Mo, and the rest Fe. It has been observed that the outside surface of such an electrode shield becomes slightly darker in color during the manufacture of the discharge lamp. Another material which is particularly suitable for the manufacture of the electrode shield is Duratherm 600, which is a CoNiCrMo alloy having an increased corrosion resistance, the composition of which is as follows: 41.5% Co, 12% Cr, 4% Mo, 8.7% Fe, 3.9% W, 2% Ti, 0.7% Al and the rest Ni.

Figure 1B:
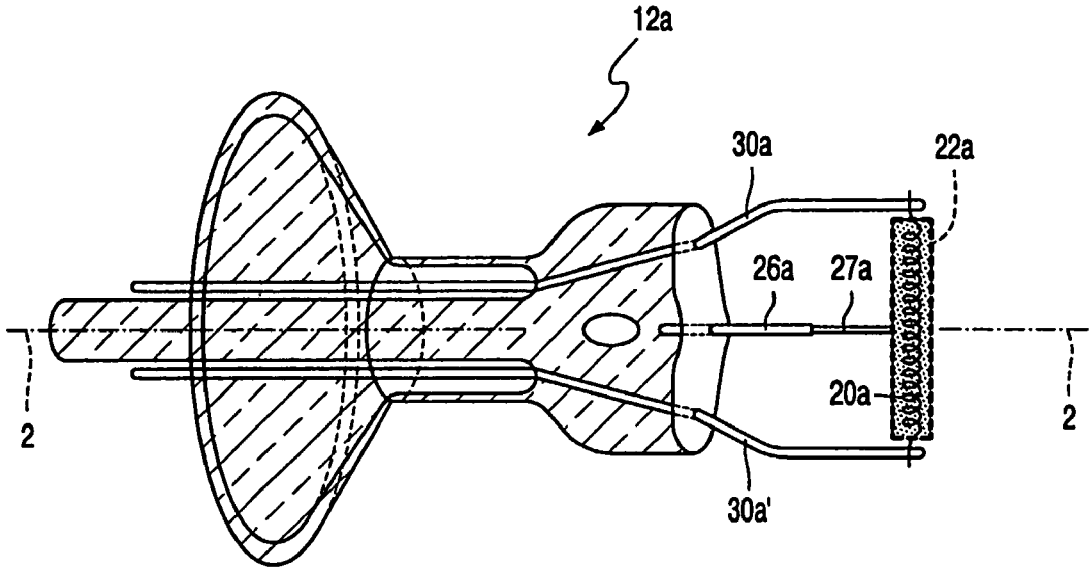
FIG. 1B shows a detail of FIG. 1A, which is partly drawn in perspective.

FIG. 1B is a partly perspective view of a detail shown in FIG. 1A, the end portion 12*a* supporting the electrode 20*a* via the current supply conductors 30*a*, 30*a*'. The electrode 22*a* shield is supported by a support wire 26*a*, 27*a*, which, in this example, is provided in the end portion 12*a*. In an alternative embodiment, the support wire 26*a*, 27*a* is connected to one of the current supply conductors 30*a*, 30*a*'. In the example shown in FIG. 2, the support wire 26*a*, 27*a* is composed of a section 26*a* of iron, having a thickness of approximately 0.9 mm, and a section 27*a* of stainless steel. The section 27*a* of the support wire 26*a*, 27*a* is connected by means of welded joints to the electrode shield 22*a* at one side and to the further section 26*a* of the support wire 26*a*, 27*a* at the other side. Stainless steel has a very low coefficient of thermal conduction with respect to the known materials (for example iron) used as support wires. The electrode shield 22*a* is capable of maintaining its comparatively high temperature because the section 27*a* of the support wire 26*a*, 27*a* effectively reduces the dissipation of heat from the electrode shield 22*a*. A stainless steel section 27*a* of the support wire having a thickness of 0.4 mm is particularly suitable. In a further alternative embodiment, the electrode shield is directly provided on the current supply conductors, for example in that the electrode shield is provided with contracted portions which are a press fit on the current supply conductors.

Figure 2:
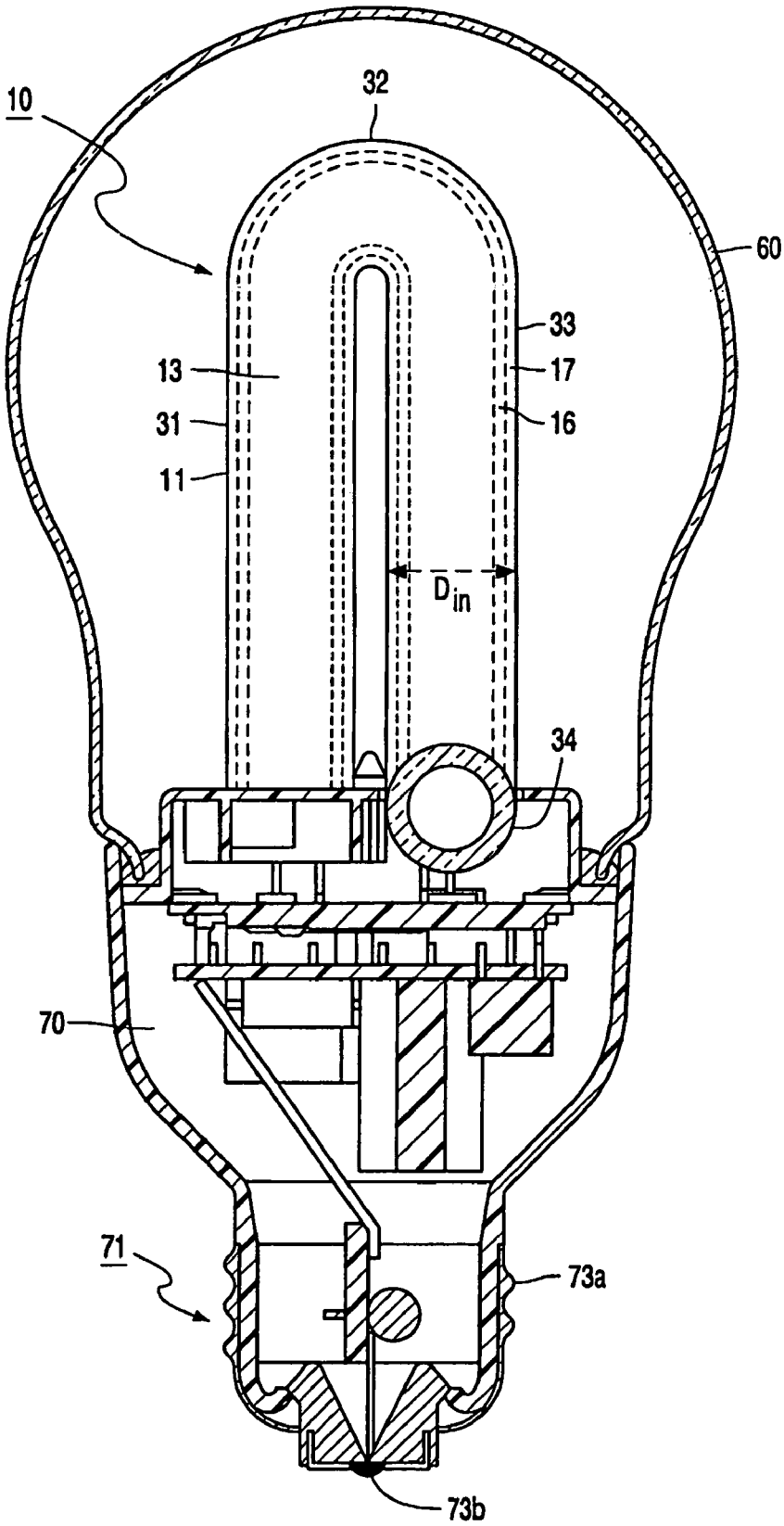
FIG. 2 is a cross-sectional view of an embodiment of a compact fluorescent lamp comprising a low-pressure mercury vapor discharge lamp according to the invention.

FIG. 2 shows a compact fluorescent lamp comprising a low-pressure mercury vapor discharge lamp. Similar components in FIG. 2 are denoted as much as possible by the same reference numerals as in FIGS. 1A and 1B. The low-pressure mercury vapor discharge lamp is in this case provided with a radiation-transmitting discharge vessel 10 having a tubular portion 11 enclosing, in a gastight manner, a discharge space 13 having a volume of approximately 25 $cm^3$. The discharge vessel 10 is a glass tube which is at least substantially circular in cross-section and the (effective) internal diameter $D_{in}$ of which is approximately 10 mm. In this example, the tubular portion 11 has a total length $L_{dv}$ (not shown in FIG. 2) of 40 cm. The tube is bent in the form of a so-called hook and, in this embodiment, it has a number of straight parts, two of which, referenced 31, 33, are shown in FIG. 2. The discharge vessel further comprises a number of arc-shaped parts, two of which, referenced 32, 34, are shown in FIG. 2. The discharge vessel 10 can, in a preferable embodiment, be closed in a gastight manner by a disc stem. Disc stem technology is quite common for conventional TV manufacturing. By using this technology in compact fluorescent lamps, frit sealing can be applied to close the burners. A melting glass then makes the vacuum-tight connection between burner tube and disc stem. This process occurs typically below 600° C. Because of this lower temperature, the internal ambient can be kept much cleaner than with conventional processing. The side of the tubular portion 11 facing the discharge space 13 is provided with a protective layer 17 according an embodiment of the invention and with a luminescent layer 16. In an alternative embodiment, the luminescent layer has been omitted. In a further alternative embodiment, the luminescent layer is coated with a further protective layer (not shown in FIG. 2). The discharge vessel 10 is supported by a housing 70 which also supports a lamp cap 71 provided with electrical and mechanical contacts 73*a*, 73*b*, which are known per se. In addition, the discharge vessel 10 is surrounded by a light-transmitting envelope 60 which is attached to the lamp housing 70. The light-transmitting envelope 60 generally has a matt appearance.

Preferably, the glass of the discharge vessel of the low-pressure mercury vapor discharge lamp has a composition comprising silicon dioxide and sodium oxide as important constituents. In the example shown in FIG. 2, the discharge vessel in accordance with the invention is made from so-called sodium-rich glass. Particularly preferred is a glass of the following composition: 70–74 wt. % $SiO_2$, 16–18 wt. % $Na_2O$, 0.5–1.3 wt. % $K_2O$, 4–6 wt. % CaO, 2.5–3.5 wt. % MgO, 1–2 wt. % $Al_2O_3$, 0–0.6 wt. % $Sb_2O_3$, 0–0.15 wt. % $Fe_2O_3$, and 0–0.05 wt. % MnO.

In an embodiment of the low-pressure mercury vapor discharge lamp, various concentrations of an $Me(Ac)_2$ solution, in which Me=Sr or Ba, and $H_3BO_3$ were added to solutions comprising various concentrations of $Y(Ac)_3$ (yttrium acetate) for manufacturing the protective layer 17. The molar ratio between $Me(Ac)_2$ and $H_3BO_3$ was kept constant. For the purpose of comparison, an 1.25% by weight solution of $Y(Ac)_3$ was also prepared. After rinsing and drying, the tubular discharge vessels were provided with a coating by passing an excess of the above solutions through the vessels. After coating, the discharge vessels were dried in air at a temperature of approximately 70° C. Subsequently, the discharge vessels were provided with a luminescent coating comprising three known phosphors, namely a green-luminescing material with terbium-activated cerium magnesium borate (CBT in CFL and CAT in TL), a blue-luminescent material. With bivalent europium-activated barium magnesium aluminate, and a red-luminescent material with trivalent europium-activated yttrium oxide. After coating, the discharge vessels were bent into the known hook shape with straight parts 31, 33 and arcuate parts 34 (see FIG. 2). A number of discharge vessels was subsequently assembled into low-pressure mercury vapor discharge lamps in the customary manner. In an alternative embodiment, the discharge vessel is first bent and coated afterwards.

Table I shows, by way of example, the mercury consumption (expressed in μg Hg) of various low-pressure mercury vapor discharge lamps (Ecotone Ambiance 20 W). The example of Table I relates to a low-pressure mercury vapor discharge lamp as shown in FIG. 2 with a protective layer comprising Sr, in which the tubular discharge vessel is bent into a hook shape and has four straight parts 31, 33 and three arcuate parts 34. The mercury contents (in μg Hg) of the protective layer were (destructively) measured for six lamps after several thousand operating hours. The values found for the mercury consumption were averaged.

TABLE I

Mercury consumption (in μg Hg) of various parts of discharge lamps (Ecotone Ambiance 20 W) with and without a protective layer.

| | | Hg consumption | |
|---|---|---|---|
| | protective layer | straight parts | bent parts |
| 1 | none | 50 | 100 |
| 2 | $Y_2O_3$ | 10 | 40 |
| 3 | $Y_2O_3$ + Sr borate | 5 | 10 |

Table I shows that the mercury consumption is considerably lower in both the straight parts 31, 33 and the bent parts 34 of the discharge vessel than in discharge lamps without a protective layer or with a known $Y_2O_3$ layer. In the example of Table I the protective layer comprises yttrium oxide and strontium borate. Roughly speaking, the mercury consumption is improved, i.e. less mercury is consumed, by a factor of two, comparing a discharge lamp without a protective layer with a discharge lamp provided with the known $Y_2O_3$ protective layer, and the mercury consumption is further improved by another factor of two, comparing a discharge lamp provided with the known $Y_2O_3$ protective layer with a discharge lamp provided with a protective layer according to an embodiment of the invention. In the bent or arc-shaped parts the gain is substantially larger (a factor of four). Due to the protective coating, the mercury consumption in, notably, the bent parts 34 of the discharge vessel is improved considerably. The latter is notably the case when relatively thick protective layers are used, because the discharge vessel is stretched by approximately 30% during bending, so that the protective layer is thinner at the bent parts 34 than at the straight parts 31, 33 of the discharge vessel 10. It is to be noted that the color point of the low-pressure mercury vapor discharge lamp provided with the protective layers satisfies the customary requirements ($x \approx 0.31$, $y \approx 0.32$).

A particularly suitable glass composition from which the discharge vessel can be made which can be used without protective coating comprises 68 wt. % $SiO_2$, less than 0.1 wt. % $Al_2O_3$, 1.6 wt. % $Li_2O$,1.9 wt. % $Na_2O$, 11 wt. % $K_2O$, 2.4 wt. % MgO, 4.5 wt. % CaO, 2.1 wt. % SrO, 8.3 wt. % BaO. The glass composition also comprises approximately 0.05 wt. % $Fe_2O_3$, approximately 0.06 wt. % $SO_3$, and approximately 0.05 wt. % $CeO_2$. The sum of the concentrations of $Li_2O$, $Na_2O$, and $K_2O$ in this embodiment of the glass composition is approximately 14.5 wt. %, and the sum of the concentrations of SrO and BaO is approximately 10.4 wt. %, giving the glass a comparatively low cost price. The melting operation is carried out in a platinum crucible in a gas-fired furnace at 1450° C. The starting materials used are quartz sand, dolomite ($CaCO_3.MgCO_3$), and the carbonates of Li, Na, K, Sr and Ba. The refining agent: used is $Na_2SO_4$. No particular problems occur during melting and further processing. The average coefficient of thermal expansion between 25° C. and 300° C.: $\alpha_{25\text{-}300}=9.2$. In addition, $T_{liq}=775°$ C., $T_{soft}=700°$ C., $T_{work}=1015°$ C., and the Working Range$=T_{work}-T_{soft}=315°$ C.

Figure 3:
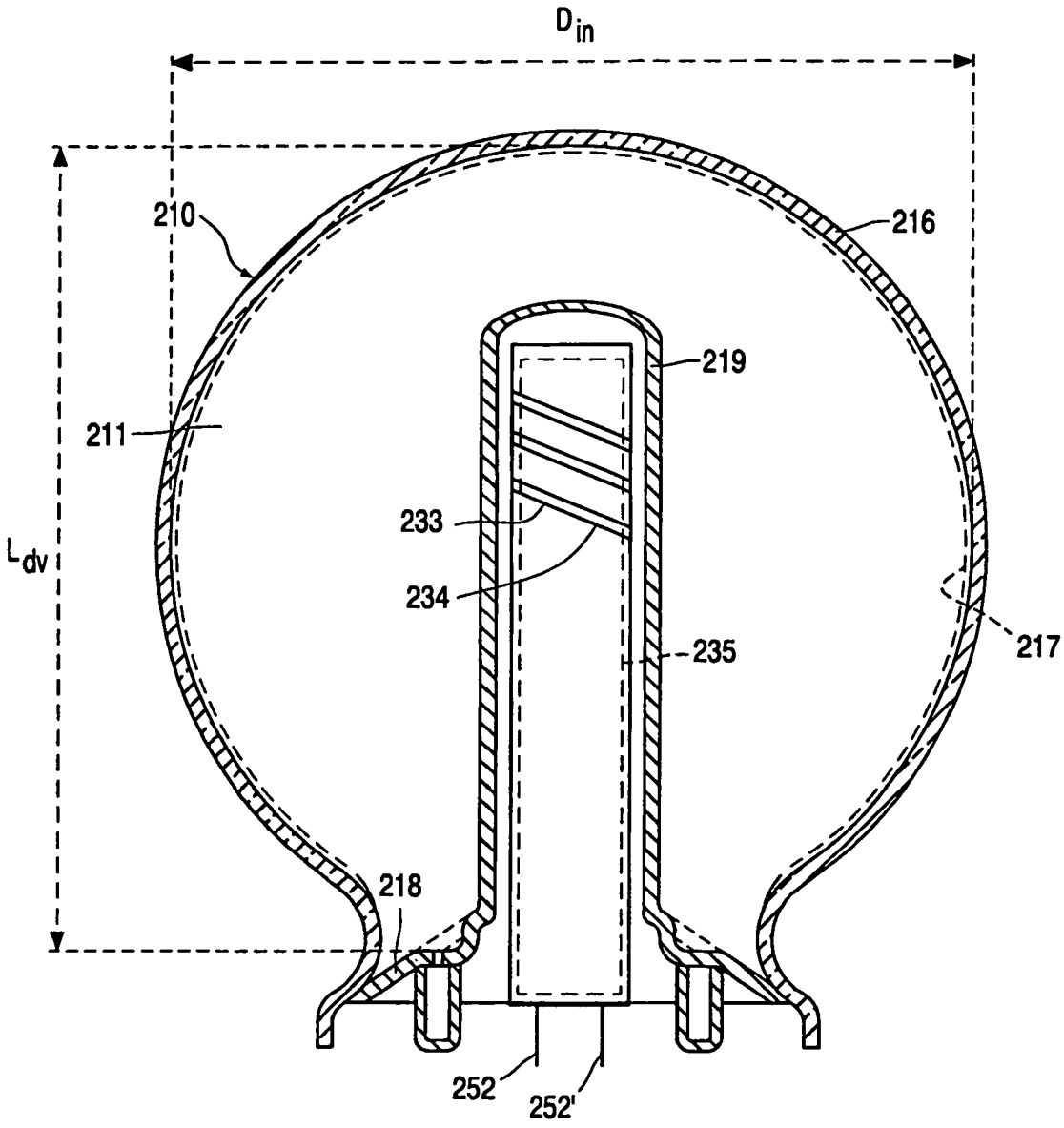
FIG. 3 shows an alternative embodiment of the low-pressure mercury vapor discharge lamp according to the invention.

FIG. 3 shows an alternative embodiment of the low-pressure mercury vapor discharge lamp according to the invention. The discharge vessel 210 of this so-called electrodeless low-pressure mercury vapor discharge lamp has a pear-shaped enveloping portion 216 and a tubular invaginated portion 219 which is connected to the enveloping portion 216 via a flared portion 218. The invaginated portion 219 accommodates a coil 233 outside a discharge space 211 surrounded by the discharge vessel 210, which coil has a winding 234 of an electrical conductor, thus constituting means for maintaining an electrical discharge in the discharge space 211. The coil 233 is fed via current supply conductors 252, 252' with a high-frequency voltage during operation, i.e. a frequency of more than approximately 20 kHz, for example approximately 3 MHz. The coil 233 surrounds a core 235 of a soft-magnetic material (shown in broken lines). Alternatively, a core may be absent. In an alternative embodiment, the coil is arranged, for example, in the discharge space 211. In FIG. 3 the internal diameter $D_{in}$ and the length of the discharge vessel $L_{dv}$ are also indicated. Normally the internal diameter $D_{in}$ ranges from approximately 80 mm to approximately 140 mm. In the example of FIG. 3 the internal diameter $D_{in}$ and the length of the discharge vessel $L_{dv}$ are approximately equal.

Figure 4:
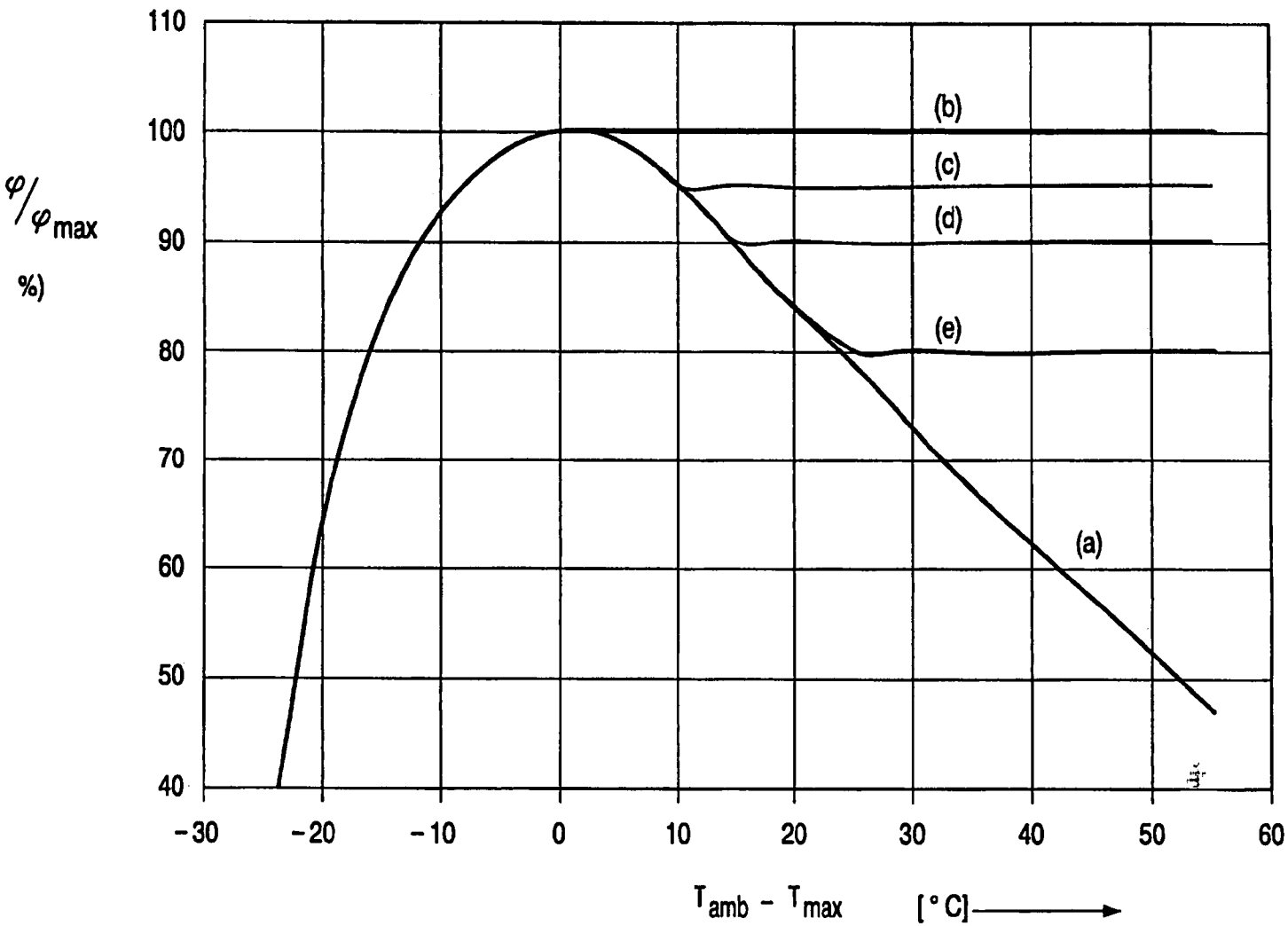
FIG. 4 shows the relative luminous flux values of low-pressure mercury vapor discharge lamps as a function of the relative ambient temperature.

FIG. 4 shows the relative luminous flux of low-pressure mercury vapor discharge lamps as a function of the relative ambient temperature for various values of the constant C. The light output or luminous flux $\phi$ is expressed as a percentage of the maximum luminous flux $\phi_{max}$ and the ambient temperature $T_{amb}$ is given relative to the temperature at the maximum luminous flux $T_{max}$. Curve (a) in FIG. 4 depicts the situation for a known low-pressure mercury vapor discharge lamp with a comparatively high amount of mercury dosed into the discharge vessel during manufacture of the discharge lamp. It can be observed from curve (a) that the luminous flux $\phi$ is dependent on the ambient temperature $T_{amb}$, i.e. the higher the ambient temperature, the lower the light output of the discharge lamp. Such temperature-dependent behavior largely limits the possibilities for further miniaturization of low-pressure mercury vapor discharge lamps, in particular of compact fluorescent lamps in which the discharge vessel 10 is surrounded by a light-transmitting envelope 60 (see FIG. 2).

Curve (b) in FIG. 4 depicts the situation for an unsaturated low-pressure mercury vapor discharge lamp according to the invention; In this example C≈0.0013. In the situation of curve (b) in FIG. 4, the discharge lamp is supplied with an amount of mercury which causes the discharge lamp to operate under unsaturated mercury conditions when the ambient temperature is approximately equal to the maximum temperature $T_{max}$. It can be seen that the luminous flux is independent of the temperature for ambient temperatures higher than $T_{max}$. With a mercury vapor discharge lamp operating under unsaturated mercury conditions, the trend in the marketplace towards further miniaturization and towards more light output can be followed.

Curve (c) in FIG. 4 depicts the situation for an unsaturated low-pressure mercury vapor discharge lamp according to the invention. In this example C≈0.0021. In the situation of curve (c) in FIG. 4, the discharge lamp is supplied with such an amount of mercury as to result in 5% less light than under optimum conditions when the lamp becomes unsaturated (corresponding to approximately 21/13 times the optimum Hg dose). It can be seen that the luminous flux is independent of the temperature for ambient temperatures approximately 10° C. above the maximum temperature.

Curve (d) in FIG. 4 depicts the situation for an unsaturated low-pressure mercury vapor discharge lamp according to the invention. In this example C≈0.0040. In the situation of curve (d) in FIG. 4, the discharge lamp is supplied with such an amount of mercury as to result in 10% less light than under optimum conditions when the lamp becomes unsaturated (corresponding to approximately 40/13 times the optimum Hg dose). It can be seen that the luminous flux is independent of the temperature for ambient temperatures approximately 15° C. above the maximum temperature.

Curve (e) in FIG. 4 depicts the situation for an unsaturated low-pressure mercury vapor discharge lamp according to the invention. In this example C≈0.008. In the situation of curve (e) in FIG. 4, the discharge lamp is supplied with such an amount of mercury as to result in 20% less light than under optimum conditions when the lamp becomes unsaturated (corresponding to approximately 80/13 times the optimum Hg dose). It can be seen that the luminous flux is independent of the temperature for ambient temperatures approximately 25° C. above the maximum temperature.

Unsaturated mercury vapor discharge lamp are quick starters and have a fast run-up time. By way of example, the initial radiation output of a typical unsaturated mercury vapor discharge lamp is approximately 38%, whereas the initial radiation output for a known discharge lamp provided with an amalgam is approximately 6%. The "run-up time" of the same unsaturated discharge lamp is approximately 75 seconds, whereas the run-up time for a known discharge lamp provided with an amalgam is approximately 210 seconds. In addition, unsaturated mercury vapor discharge lamps have a 25% lower ignition voltage than known discharge lamp provided with an amalgam. Unsaturated mercury vapor discharge lamp typically contain less than 0.1 mg mercury.

Figure 5:
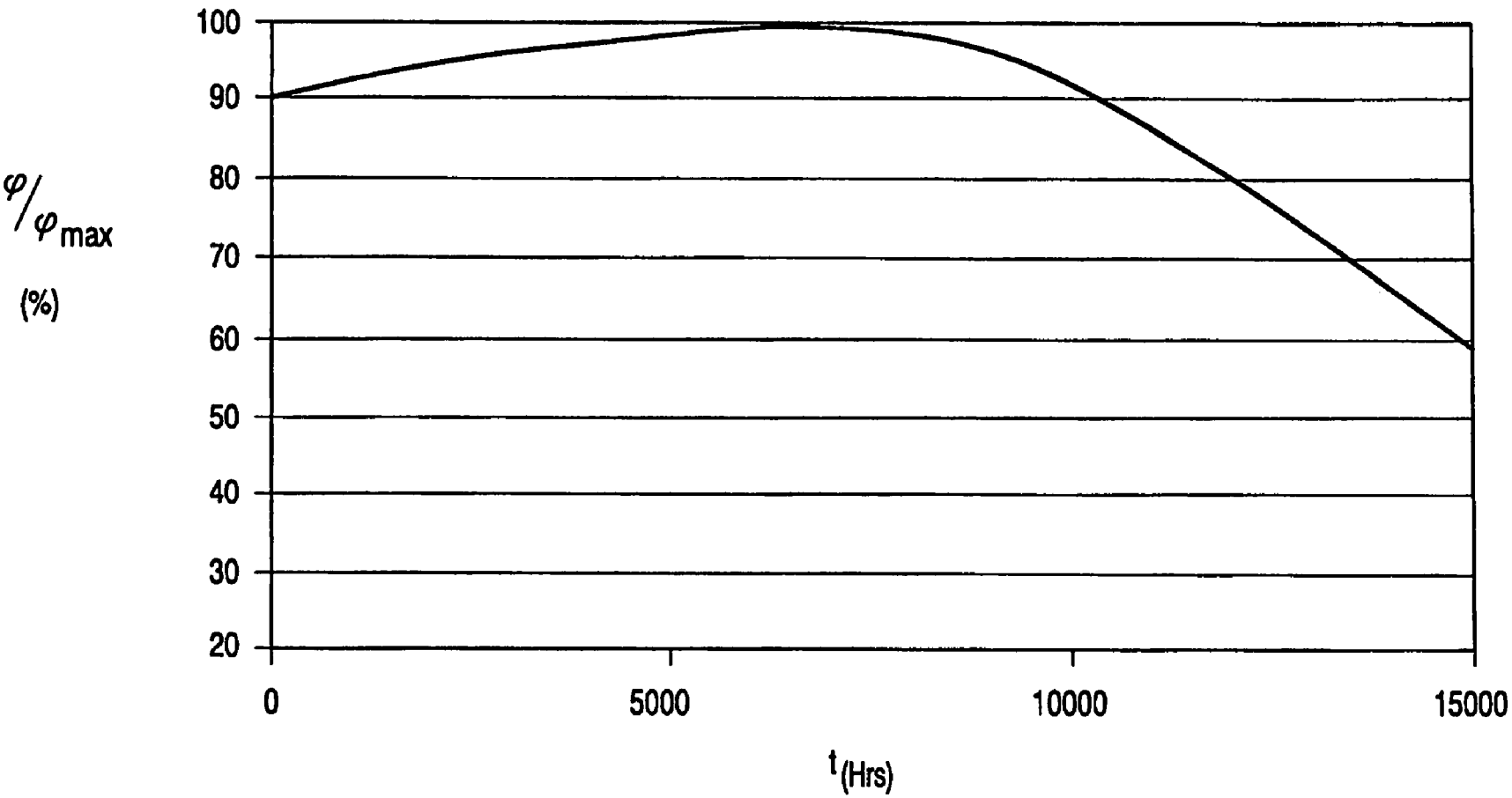
FIG. 5 shows the relative luminous flux values of a low-pressure mercury vapor discharge lamp according to the invention.

It was observed from experiments that the lumen maintenance of unsaturated mercury vapor discharge lamp is higher than approximately 98% at 10,000 hours. FIG. 5 shows a typical example of the relative light output of a low-pressure mercury vapor discharge lamp according to the invention (corresponding to a discharge lamp under the conditions of curve (d) (C≈0.04) in FIG. 4). The light output or luminous flux $\phi$ is expressed as a percentage of the maximum luminous flux $\phi_{max}$, and the time t is given in hours. Note that the behavior of an unsaturated mercury vapor discharge lamp is somewhat different from what is normally observed for discharge lamps containing known amounts of mercury. The maximum light output is not reached until after more than 5000 hours.

Figure 6:
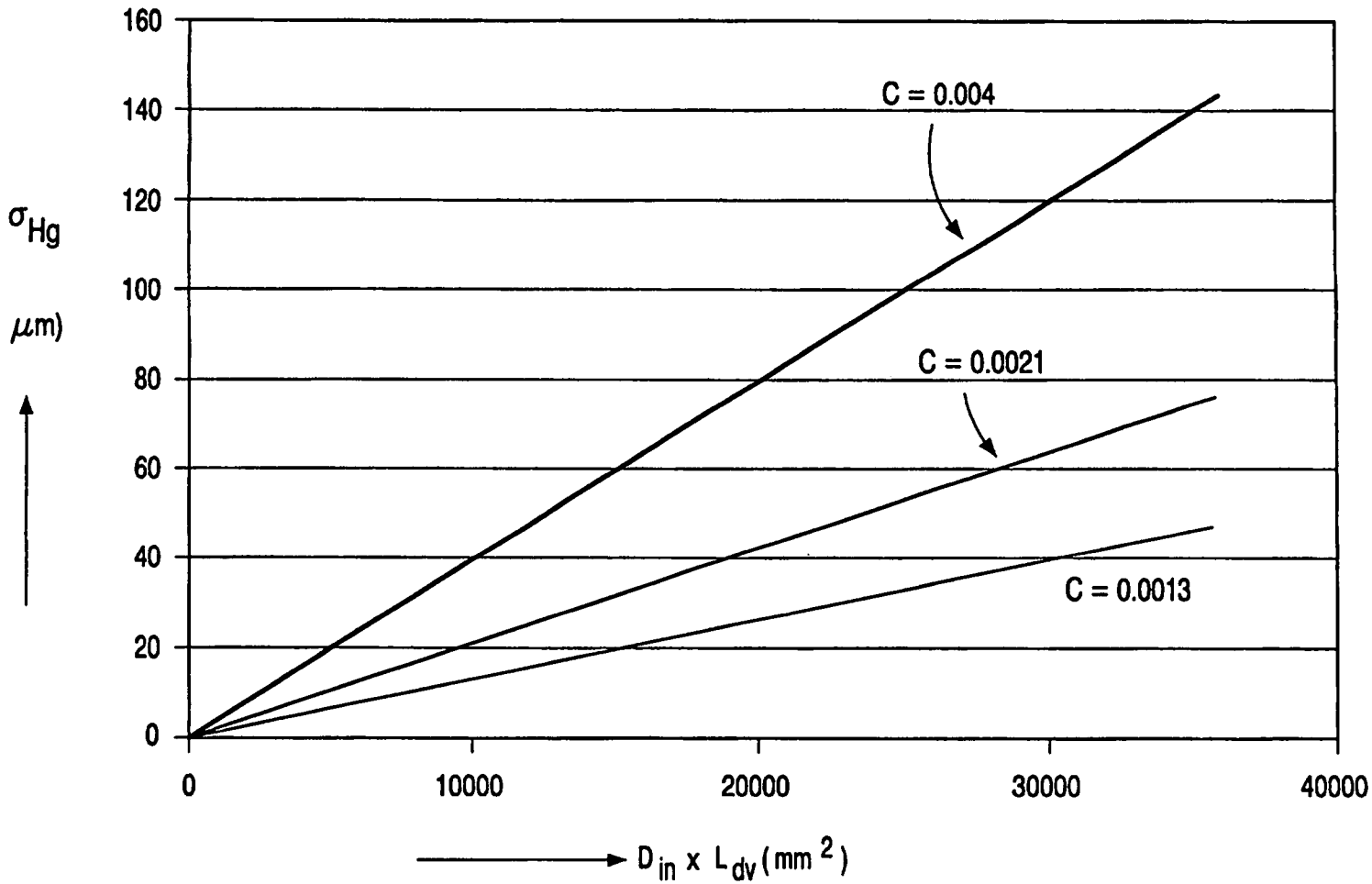
FIG. 6 shows the amount of mercury as a function of the product of the internal diameter $D_{in}$ and the length of the discharge vessel $L_{dv}$.

FIG. 6 shows the amount of mercury as a function of the product of the internal diameter $D_{in}$ and the length of the discharge vessel $L_{dv}$ for three different values of C, i.e. C=0.0013, C=0.0021 and C=0.004. In known low-pressure mercury vapor discharge lamps, the amounts of mercury dosed during manufacture of the discharge lamp are considerably higher. For normal tubular fluorescent lamps, with $D_{in} \times L_{dv}$ in a range from $12.10^3$ to $35.10^3$ mm$^2$, the amount of mercury is in a range of $3.10^3$14 $15.10^3$ μg Hg. For known compact fluorescent lamps with $D_{in} \times L_{dv}$ in the range from approximately $10^3$ to $10.10^3$ mm$^2$, the amount of mercury is in the range of $3.10^3$–$10.10^3$ μg Hg.

According to the measures of the invention, unsaturated lamps combine a minimum mercury content with an improved lumen per Watt performance at elevated temperatures.

It will be evident that many variations within the scope of the invention can be conceived by those skilled in the art.

The scope of the invention is not limited to the embodiments. The invention resides in each new characteristic feature and each combination of novel characteristic features. Any reference signs do not limit the scope of the claims. Forms of the verb "comprise" do not exclude the presence of other elements or steps than those listed in a claim. Use of the word "a" or "an" preceding an element does not exclude the presence of a plurality of such elements.

The invention claimed is:

1. A low-pressure mercury vapor discharge lamp comprising an at least partly substantially cylindrical discharge vessel with a length $L_{dv}$ and with an internal diameter $D_{in}$, the discharge vessel enclosing, in a gastight manner, a discharge space provided with a inert gas mixture and with mercury, the discharge vessel comprising discharge means for maintaining a discharge in the discharge space, characterized in that the ratio of the weight of mercury $m_{Hg}$ in the discharge vessel to the product of the internal diameter $D_{in}$ and the length of the discharge vessel $L_{dv}$ is given by the relation:

$$\frac{m_{Hg}}{D_{in} \times L_{dv}} = C,$$

wherein C≦0.01 μg/mm$^2$.

2. A low-pressure mercury vapor discharge lamp as claimed in claim 1, characterized in that $0.0005 \leqq C \leqq 0.005$ $\mu g/mm^2$.

3. A low-pressure mercury vapor discharge lamp comprising an at least partly substantially cylindrical discharge vessel with a length $L_{dv}$ and with an internal diameter $D_{in}$, the discharge vessel enclosing, in a gastight manner, a discharge space provided with a inert gas mixture and with mercury, the discharge vessel comprising discharge means for maintaining a discharge in the discharge space, characterized in that the product of the mercury pressure $P_{Hg}$ and the internal diameter $D_{in}$ of the discharge vessel is in a range of $0.13 \leqq P_{Hg} \times D_{in} \leqq 8$ Pa.cm.

4. A low-pressure mercury vapor discharge lamp as claimed in claim 3, characterized in that the product of the mercury pressure $p_{Hg}$ and the internal diameter $D_{in}$ of the discharge vessel is in a range of $0.13 \leqq P_{Hg} \times D_{in} \leqq 4$ Pa.cm.

5. A low-pressure mercury vapor discharge lamp as claimed in claim 1, characterized in that the discharge vessel contains less than 0.1 mg mercury.

6. A low-pressure mercury vapor discharge lamp as claimed in claim 1, characterized in that the discharge means comprises electrodes arranged in the discharge space, in that an electrode shield at least substantially surrounds at least one of the electrodes, and in that the electrode shield is made from a ceramic material or from stainless steel.

7. A low-pressure mercury vapor discharge lamp as claimed in claim 1, characterized in that the means for maintaining an electric discharge are situated outside a discharge space surrounded by the discharge vessel, and in that said means comprise a coil provided with a winding of an electrical conductor, with a high-frequency voltage, for example having a frequency of approximately 3 MHz, being supplied to said coil in operation.

8. A low-pressure mercury vapor discharge lamp as claimed in claim 1, characterized in that the product of the pressure of the inert gas mixture $p_{igm}$ and the internal diameter $D_{in}$ of the discharge vessel is in a range of $P_{igm} \times D_{in} \geqq 5.2$ Pa.m.

9. A low-pressure mercury vapor discharge lamp as claimed in claim 8, characterized in that $p_{igm} \times D_{in} \geqq 8$ Pa.m.

10. A low-pressure mercury vapor discharge lamp as claimed in claim 1, characterized in that at least a portion of an inner wall of the discharge vessel is provided with a protective layer, and in that the protective layer comprises a material selected from the group formed by oxides of scandium, yttrium, and a further rare-earth metal, and/or a material selected from the group formed by borates of an alkaline-earth metal, scandium, yttrium, and a further rare-earth metal, and/or a material selected from the group formed by phosphates of an alkaline-earth metal, scandium, yttrium, and a further rare-earth metal.

11. A low-pressure mercury vapor discharge lamp as claimed in claim 10, characterized in that the alkaline-earth metal is calcium, strontium, and/or barium.

12. A low-pressure mercury vapor discharge lamp as claimed in claim 10, characterized in that the further rare-earth metal is lanthanum, cerium, and/or gadolinium.

13. A low-pressure mercury vapor discharge lamp as claimed in claim 10, characterized in that the oxide is yttrium oxide and/or gadolinium oxide.

14. A low-pressure mercury vapor discharge lamp as claimed in claim 10, characterized in that the discharge vessel is made from a glass comprising silicon dioxide and sodium oxide, with a glass composition comprising the following essential constituents, given in percentages by weight (wt. %): 60–80 wt. % $SiO_2$ and 10–20 wt. % $Na_2O$.

15. A low-pressure mercury vapor discharge lamp as claimed in claim 14, characterized in that the glass composition includes the following constituents:

70–75 wt. % $SiO_2$, 15–18 wt. % $Na_2O$, and 0.25–2 wt. % $K_2O$.

16. A low-pressure mercury vapor discharge lamp as claimed in claim 1, characterized in that the discharge vessel is made from a glass which is substantially free of PbO and which compromises, expressed as a percentage by weight, the following constituents: 55–70 wt. % $SiO_2$, <0.1 wt. % $Al_2O_3$, 0.5–4 wt. % $Li_2O$, 0.5–3 wt. % $Na_2O$, 10–15 wt. % $K_2O$, 0–3 wt. % MgO, 0–4 wt. % CaO, 0.5–5 wt. % SrO, 7–10 wt. % BaO.

17. A low-pressure mercury vapor discharge lamp as claimed in claim 16, characterized in that the composition of the discharge vessel comprises:

65–70 wt. % $SiO_2$, 1.4–2.2 wt. % $Li_2O$, 1.5–2.5 wt. % $Na_2O$, 11–12.3 wt. % $K_2O$, 1.8–2.6 wt. % MgO, 2.5–5 wt. % CaO, 2–3.5 wt. % SrO, 8–9.5 wt. % BaO.

18. A low-pressure mercury vapor discharge lamp as claimed in claim 16, characterized in that the composition of the discharge vessel in addition comprises:

0.01–0.2 wt. % $Fe_2O_3$ and/or 0.01–0.2 wt. % $CeO_2$ and/or 0.01–0.15 wt. % $SO_3$.

19. A low-pressure mercury vapor discharge lamp as claimed in claim 16, characterized in that the sum of the concentrations of $Li_2O$, $Na_2O$, and $K_2O$ is in a range from 14 to 16 wt. % and/or the sum of the concentrations of SrO and BaO is in a range from 10 to 12.5 wt. %.

20. A compact fluorescent lamp comprising a low-pressure mercury vapor discharge lamp as claimed in claim 1, characterized in that a lamp housing is attached to the discharge vessel of the low-pressure mercury vapor discharge lamp, which lamp housing is provided with a lamp cap.

* * * * *